United States Patent [19]

Czetto, Jr.

[11] Patent Number: 4,938,147

[45] Date of Patent: Jul. 3, 1990

[54] HIGH IMPACT EXPANDABLE BULLET

[76] Inventor: Paul Czetto, Jr., 163 Cocoa Dr., Tavernier, Fla. 33070

[21] Appl. No.: 363,043

[22] Filed: Jun. 7, 1989

[51] Int. Cl.[5] ..... F42B 12/34

[52] U.S. Cl. ..... 102/507; 102/517

[58] Field of Search ..... 102/501, 506, 507–510, 102/517–519

[56] References Cited

U.S. PATENT DOCUMENTS

| | | | |
|---|---|---|---|
| 450,623 | 4/1891 | Kauderer | 102/507 |
| 622,582 | 4/1899 | Wyatt | 102/507 |
| 644,361 | 2/1900 | Luciani | 102/517 |
| 1,017,928 | 2/1912 | Tocik | 102/506 |
| 1,081,065 | 12/1913 | Starkweather | 102/507 |
| 2,401,380 | 6/1946 | Teitscheid | 102/507 |
| 4,307,666 | 12/1981 | Baran | 102/501 |

FOREIGN PATENT DOCUMENTS

| | | | |
|---|---|---|---|
| 734429 | 4/1943 | Fed. Rep. of Germany | 102/517 |

*Primary Examiner*—Harold J. Tudor

*Attorney, Agent, or Firm*—Larson and Taylor

[57] ABSTRACT

A collapsible bullet is provided which rapidly expands upon impact and possesses excellent penetration characteristics. The bullet includes at least two separate parts which form an integrated unit, i.e., a nose part having a central bore therethrough and a base or rear part which includes a central collapse column that projects through the opening in the nose part. The distal end of the collapse column is peened over to help hold the parts together. After initial impact by the leading end of the nose part, successive impacts are produced by the rear part, and any intermediate parts, as these parts are driven into the nose part, thereby causing an outward expansion of the nose part and possible complete penetration of the nose part by the rear part or parts.

6 Claims, 2 Drawing Sheets

HIGH IMPACT EXPANDABLE BULLET

CROSS REFERENCE TO RELATED APPLICATIONS

This application is directed to subject matter related to that disclosed and claimed in co-pending application Ser. No. 917,780 filed on Oct. 10, 19861, now abandoned.

FIELD OF THE INVENTION

This invention relates to bullets and, more particularly, to an improved collapsible bullet which expands laterally after impact.

BACKGROUND OF THE INVENTION

There are, of course, many different types of bullets which have been made and are currently being made, and the material, construction, shape, dimensions, and/or configurations of prior art bullets have been varied in many different ways and in many different combinations in order to control the operational characteristics of the bullet, i.e., to control the effect the bullet has on a target upon impact. In this regard, some bullet constructions are specifically designed to travel at relatively high velocities and provide deep penetration. Alternately, some bullets are designed to sacrifice some penetration while providing for a significantly greater outward expansion or flattening of the bullet after the bullet strikes the target area. Many bullet constructions are relatively complex, and require complicated, labor intensive manufacturing steps or techniques which raise the overall cost of manufacture. In addition, prior art bullet constructions are generally intended to provide a specific performance characteristics, such as improved expansion, to the detriment of other characteristics, such as penetration.

Some prior art bullet constructions include multiple segments. In most instances, these prior art bullet constructions employ an external jacket, and the specific bullet configuration is designed to cooperate with i.e., act in concert with, the external jacket to provide specific performance characteristics such as those discussed above.

SUMMARY OF THE INVENTION

The present invention concerns an improved bullet construction, and a method of making such a bullet construction, wherein the bullet undergoes controlled lateral expansion after impacting a target. In addition to providing such controlled expansion upon impact the bullet of the invention also possesses superior penetration characteristics as compared with many constructions, and in particular, as compared with bullets that are specifically designed to flatten and expand laterally upon striking a target area.

The bullet of the invention is capable of being constructed and dimensioned for use in a handgun, rifle or other firearm of substantially any caliber and, in general, whatever the caliber or whatever the firearm, provides, as discussed above, controlled flattening and lateral expansion of the bullet upon striking a target while still providing excellent penetrating characteristics.

In accordance with a preferred embodiment, an expandable bullet is provided which includes a leading end and a trailing end and which, when fired, expands upon impact, the bullet comprising: a first, nose part disposed at the leading end of the bullet and including a central opening therein; and a second, separately formed rear part including a base portion which defines the trailing end of the bullet and a central column extending outwardly from said base portion through the central opening of the nose part. The distal end of the central column includes laterally extending portions which overlie portions of the nose part that define the distal end of the central opening, so as to assist in holding the two parts together.

In an important embodiment, the bullet further includes at least one intermediate, separately formed part disposed between the nose part and rear part so that the bullet is made up of at least three separately formed parts..

In all embodiments, the laterally extending portions of the distal end of the central column and laterally adjacent portions of nose part preferably form a continuous rounded curved surface which constitutes the nose of the bullet.

The base portion of the rear part advantageously includes a rounded substantially semi-elliptical surface which terminates in a substantially flat rear surface while the nose part advantageously includes a curved concave rear surface of a shape which substantially conforms to the shape of the rounded surface of the rear part.

In a preferred embodiment, the bullet of the invention further comprises a crimping cannelure provided in an area wherein external surfaces of the nose part and said rear part lie adjacent to one another.

In accordance with a further important aspect of the invention, a method is provided for making a unitary, two part expandable bullet which, upon being fired, expands upon impact, the method comprising: molding a first bullet part; forming a central opening in the first bullet part which extends completely through that part; molding and forming a second, separate bullet part including a base portion and a central elongate column extending outwardly from that base portion and of a length greater than the length of the central opening in the first part; disposing the first bullet part on the second bullet part by inserting the elongate column of the second part into the central opening in the first part so that a portion of the distal end of the column projects outwardly beyond the first part; and forming the first and second parts together into a unitary bullet. The last step includes shaping the projecting portion of the distal end of the column so lateral positions thereof overlie portions of the adjacent surface of the first part, so as to assist in holding the two parts together and to thereby form a unitary bullet from the first and second separate parts.

Advantageously, the projecting portion of the column is peened over the adjacent portions of the first part. Preferably, the leading end of the bullet is further shaped after the projecting portion of said column is peened over so as to provide the final nose shape of the bullet. The first part is advantageously formed so as to include a shaped recess in the rear surface thereof which fits over the front surface of the base portion of the second part. Advantageously, the shaped recess is initially formed so as to be substantially frusto-conical in shape. In a specific, advantageous embodiment the front surface of the base portion of the second part is formed so as to be semi-elliptical in shape.

In a preferred embodiment, the first and second bullet parts are initially molded into blanks of substantially identical shapes. Further, in accordance with another aspect of this invention, subsequent to the initial molding of the blanks, pressure is applied to the blanks, in a die, to form substantially identical, highly uniform bullet cores used to make said first and second bullet parts. Preferably, the central opening in the first is formed by drilling.

In an alternate embodiment, the second part includes an external jacket formed over a portion of the external surface thereof.

In a further important embodiment, at least one intermediate part is disposed between the first and second parts in the finished bullet, the intermediate part or parts each being provided with a central opening therein through the elongate column extends.

Other features and advantages of the invention will be set forth in, or apparent from, the following detailed description of preferred embodiments of the invention.

DETAILED DESCRIPTION OF THE DRAWINGS

Figure 1:
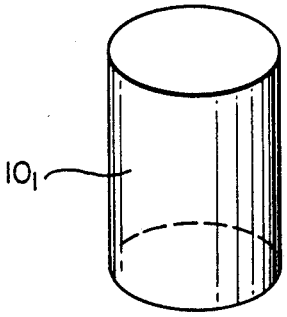
FIG. 1 is a perspective view of a first lead core used in making a first part of the bullet of the invention.
Figure 2:
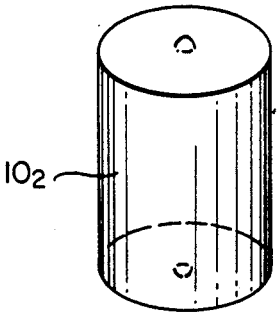
FIG. 2 is a perspective view of the lead core of FIG. 1 as modified during the next stage in the manufacturing process.
Figure 3:
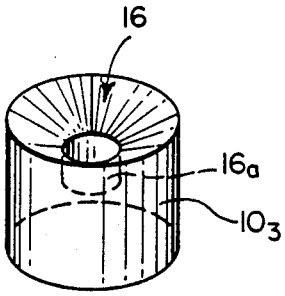
FIG. 3 is a perspective view of the lead core of FIG. 2 as modified during the next stage in the manufacturing process.
Figure 4A:
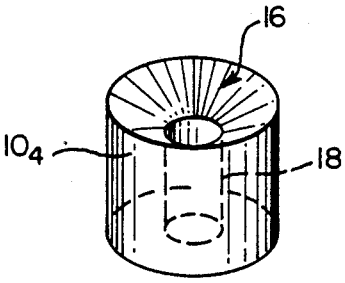
Figure 4B:
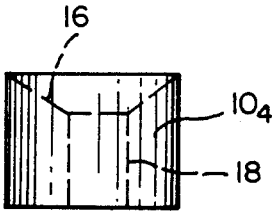
Figure 5:
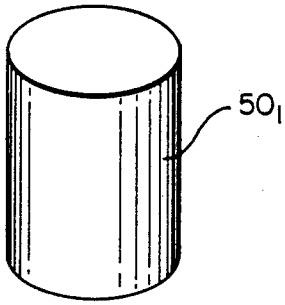
Figure 6:
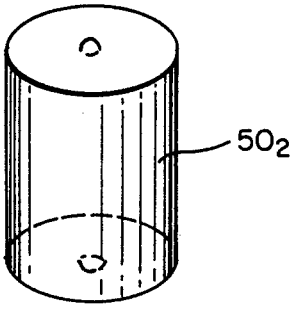
Figure 7A:
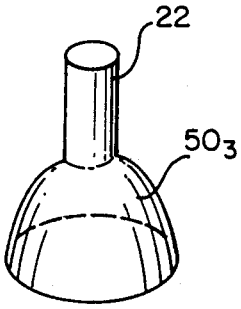
Figure 7B:
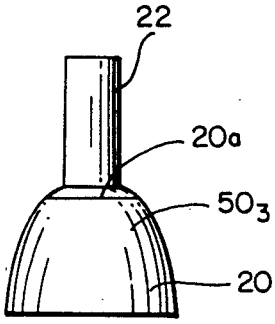
Figure 10:
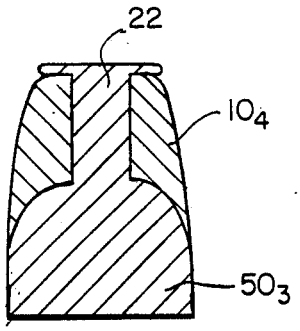
Figure 11:
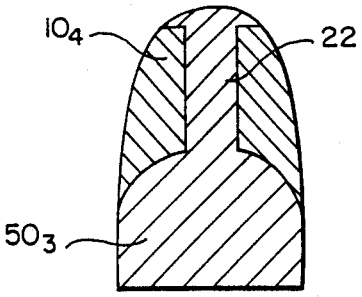
Figure 12:
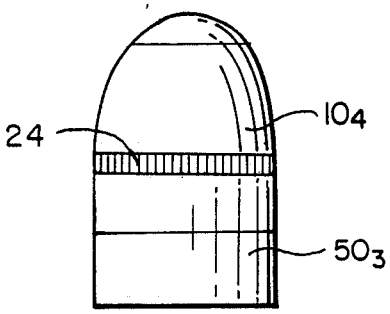
Figure 13:
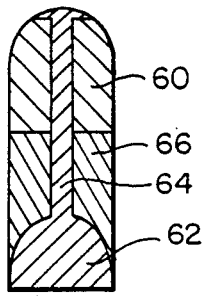
Figure 14:
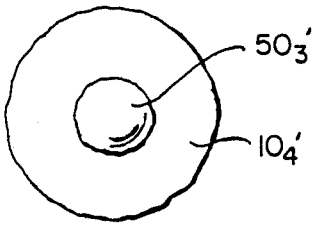
Figure 15:
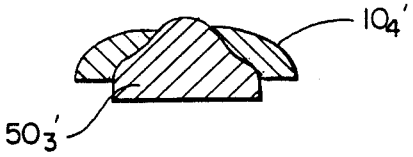

FIGS. 4(*a*) and 4(*b*) are perspective and side elevational views, respectively, of the lead core of FIG. 3 as modified during the next stage of the manufacturing process;

FIGS. 5 and 6 are perspective views corresponding to FIG. 1 and 2 of a second lead core used in making a second part of the bullet of the invention;

FIGS. 7(*a*) and 7(*b*) are perspective and side elevational views, respectively, of the second bullet part FIG. 6 as modified during the next stage of the manufacturing process. FIGS. 8, 9, 10, and 11 are cross-sectional views of the bullet parts of FIGS. 4(*a*), 4(*b*), and 7(*a*), 7(*b*), respectively, showing further stages wherein in the two parts are assembled together and further processed during the formation of a bullet in accordance with one preferred embodiment of the invention;

FIG. 12 is a side-elevational view of a finished bullet produced by the process illustrated in FIGS. 1 to 11;

FIG. 13 is a cross sectional view of a further preferred embodiment of the invention which comprises three separate bullet parts or components; and FIGS. 14 and 15 are a top plan view and a transverse cross-sectional view, respectively, of the bullet of FIG. 12, after being fired and having impacted against a target.

DESCRIPTION OF THE PREFERRED EMBODIMENTS

Referring to FIG. 1, and to FIG. 5, lead cores or bodies, denoted $10_1$ and $50_1$ in the respective figures, are shown which are used in making the multiple-part bullet of the invention. To produce bodies $10_1$ and $50_1$ the lead is first melted down and then poured into a suitable mold which produces the two semi-uniform core weights or bodies 10, and 50. Such a mold is conventional and can, for example, be a "Corbin Core" mold manufactured by Corbin Manufacturing and Supply, Inc. Preferably the core weights $10_1$ and $50_1$ are cylindrical as shown, although other shapes can be produced as well.

FIGS. 2 and 6 shown the cores of FIGS. 1 and 5 after processing during the next stage of the manufacturing process. A bleeder die (not shown) with internal and external punches separately receives cores corresponding to those of FIGS. 1 and 5, and the punches are then used to apply pressure, with excess lead being extruded through the bleeder holes of the die. The result is the extremely uniform generally cylindrical bullet cores $10_2$ and $50_2$ as shown in FIGS. 2 and 6. Considering bullet core $10_2$ as exemplary, typically a small rounded projection 12 is produced at one end while a small indentation or dimple 14 is produced at the other, through the action of the punches.

It will be appreciated that the processing steps up to now have been the same for both bullet cores and two separate cores have been shown to emphasize that two separate, although substantially identical bullet parts are produced. The two cores or bullet parts 10 and 50 are processed in totally different ways during the following stages in the manufacturing process.

Referring to FIG. 3, and considering the further processing of the first part or component of the bullet of the invention as made in accordance with the exemplary embodiment under consideration, a die body of the desired diameter (e.g., 0.357 inches) and an internal punch with a suitably angled tip (not shown) are used to convert core $10_2$ into a core $10_3$ of the shape shown in FIG. 3. In particular, core $10_2$ is placed into the die body which swages what is to become the nose of the bullet and there is produced, by the action of the punch with the angled tip, a flared hollow 16 at the rear of the bullet nose-forming core $10_3$. Hollow 16 is of generally frusto-conical shape and may include a central recess or dimple therein 16*a* caused by the die. It will be understood that this general approach can be used for bullets of any caliber using different dies providing the appropriate diameters.

As shown in FIG. 4 the bullet nose-forming core, denoted $10_4$, is, during the next stage of the manufacturing process, drilled therethrough, to provide a central hole or bore 18 therein. The purpose of this hole 18 is discussed below.

Turning now to the further steps in the manufacture of the rear part of the bullet of the invention and referring to FIGS. 7(*a*) and 7(*b*), a nose forming die (not shown) with an internal ejection punch and external punch is used to form core $50_2$ of FIG. 6 into a core or body $50_3$ having the "oil can" shape illustrated. More specifically, rear core $50_2$ is swaged by the nose forming die, through the use of excessive pressure and lubricants, into shaped core $50_3$, the latter including a base portion 20 which is generally the shape of one-half of an ellipse (i.e., semi-elliptical) with a flat bottom and upper, central, generally cylindrical, outwardly (upwardly) projecting collapse column 22.

It is to be understood that in accordance with an alternate embodiment an outer jacket (not shown) of a different metal can be provided around base portion 20 that extends up to the level indicated at 20*a*.

Figure 8:
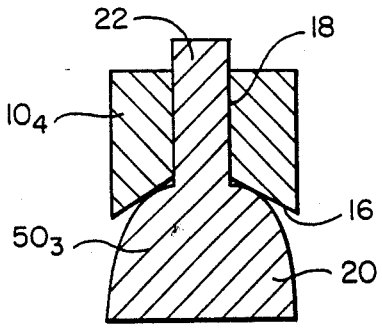
Figure 9:
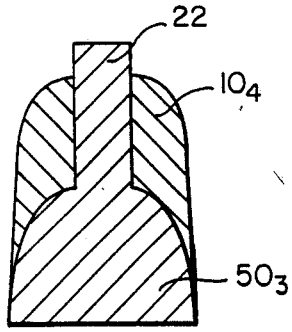

Referring to FIGS. 8 to 11, illustrated therein are the steps or stages employed in forming the two bullet parts or components $10_4$ and $50_3$ into the final bullet. As shown in FIG. 8, nose core $10_4$ is inverted with respect to the orientation shown in FIG. 4(*a*) and 4(*b*) and placed onto rear core $50_3$, with collapse column 22 being received in and projecting through the hole or bore 18 in nose core $10_4$. Thereafter, as shown in FIG. 9, the nose forming die (not shown) with an internal punch and an external punch is used to press the components $10_4$ and $50_3$ together and to form the upper or front component $10_4$ into a bullet nose shape. In the next step, the external punch is backed off a desired distance to enable peening over of the distal end of the central collapse column 22 of rear part or component $50_3$, as illustrated in FIG. 10, thereby joining the two bullet parts together. It is noted that with a die of the type described, the bullet so formed is inverted during this procedure so as to enable the collapse column 22 to come into contact with the external punch of the die. In a final step, the external punch of the nose forming die is readjusted, the bullet formed by parts $10_4$ and $50_3$ is lubricated and is oriented to face the nose forming die, and pressure is applied to shape the leading edge of the bullet into a rounded or other shaped ogive. As shown in FIG. 12, a crimping cannelure 24 can be provided in the bullet in the area of the external line of intersection of the two parts $10_4$ and $50_3$.

Before turning to a consideration of the "operation" of the bullet of the invention, i.e., of what happens to the bullet upon impact, it should be understood that the bullet of the invention can include multiple parts or components and, as illustrated in FIG. 13, can be made up of three parts, viz., a nose part 60 generally corresponding to nose part $10_4$ of FIG. 11, a base part 62 with a collapse column 64 generally corresponding to the base $50_3$ of FIG. 11, and a third, intermediate part 66 which is also received on column 64 along with nose part 60. As illustrated in FIGS. 11 and 13, the column (22 or 64) is relatively long as compared with the overall length of the bullet and as shown in FIG. 11, is at least substantially equal in length to the length of the base portion.

Turning now to the "operation" of the bullet of the invention, and, in particular, to the kinetic energy transfer provided within the bullet and the shock waves resulting therefrom, and comparing FIG. 11 with FIGS. 14 and 15 which show the bullet of FIG. 11 after impact, when the bullet is in flight all parts thereof, i.e., parts $10_4$ and $50_3$ in the embodiment of FIG. 11, travel as a unit and have the same velocity. When a resistance is encountered, the leading or nose portion, i.e., the end formed by the distal end or tip of column 22 and the nose portion of part $10_4$, makes initial contact and decelerates very rapidly. It will be appreciated that when nose $10_4$ initially makes impact, the rear part $50_3$ is still travelling at the same velocity and no energy is transferred from the rear $50_3$ at that instant. It will also be understood that the length of the collapse column 22 will determine the amount of time it takes for energy to be transferred from the rear part $50_3$ of the bullet to nose part $10_4$. As the rear part $50_3$ continues to travel forward while the nose part $10_4$ is stopped and then flattened out by its impact with the target, energy is transferred from rear part $50_3$ to nose part $10_4$ and when, as shown in FIGS. 14, and 15, the rear part, denoted $50_3'$, penetrates the nose part, denoted $10_4'$, the latter will be caused to further laterally expand as illustrated. In addition, the original shock wave produced by initial impact is reinforced or augmented by the further acceleration of the leading part $10_4'$, and, in addition, a new shock wave is produced as the rear section $50_3'$ penetrates and emerges through flattened and expanded front or nose part $10_4'$. Thus, a cummulative shock effect is produced by: (1) the original impact of the bullet and the attendant deceleration; (2) the further acceleration of the nose part $10_4'$ as energy is transferred thereto from the rear part $50_3'$ and (3) the impact of the rear part $50_3'$ as it moves as a substantially independent body. If the rear part $50_3'$ does not penetrate the forward or nose part $10_4'$ there is a complete kinetic energy transfer between the parts themselves.

Although the foregoing theory of operation is believed to accurately describe the manner in which energy is transferred and impact forces are generated when the bullet of the invention impacts against a resistance, it is possible that other theoretical explanations are applicable at least with respect to some aspects of the operation set forth above. However, it should be understood that the showing in FIGS. 14 and 15 of a spent bullet, after impact, is not theoretical but is representative of what the bullet looks like after actual tests, with the nose part $10_4'$ in the shape of a flattened annulus or ring and with the rear part $50_3'$ penetrating through the ring formed by the nose part and being flattened at the distal end.

Although the present invention has been described relative to specific exemplary embodiments thereof, it will be understood by those skilled in the art that variations and modifications can be effected in these exemplary embodiments without departing from the scope and spirit of the invention.

What is claimed is:

1. An expandable bullet which includes a leading end and a trailing end and which, when fired, expands upon impact, said bullet having a substantially smooth, continuous side wall and comprising:

a first, nose part of a soft metal comprising lead disposed at the leading end of the bullet and including a central opening therein; and a second, separately formed, unitary, one piece rear part of a soft metal comprising lead, said rear part comprising a base portion which defines the trailing end of the bullet and an integral central column of a substantially smaller diameter than said base portion extending outwardly from said base portion through the central opening of said nose part, the diameter of said base portion being substantially equal to the base diameter of the bullet, the distal end of said central column including laterally extending portions which overlie portions of said nose part defining the distal end of said central opening so as to assist in holding the two parts together, and said column being at least substantially equal in length to said base portion and being cylindrical in shape over substantially the entire length thereof apart from said laterally extending portions.

2. An expandable bullet as claimed in claim 1 wherein said laterally extending portions of the distal end of the central column and laterally adjacent portions of the nose part form a continuous round curved surface which constitutes the nose of the bullet.

3. An expandable bullet as claimed in claim 1 wherein said bullet further includes at least one intermediate separately formed part disposed between said nose part and rear part.

4. An expandable bullet as claimed in claim 1 wherein said base portion of said rear part includes a rounded substantially semi-elliptical surface and terminates in a substantially flat rear surface and said nose part includes a curved concave rear surface of a shape which substantially conforms to the shape of the rounded surface of said rear part.

5. An expandable bullet as claimed in claim 1 wherein said bullet further comprises a crimping cannelure provided in an area wherein external surfaces of said nose part and said rear part lie adjacent to one another.

6. An expandable bullet as claimed in claim 1 wherein said base portion of said rear part includes an upper surface which varies in diameter between a diameter at the top thereof substantially equal to the diameter of said column and a diameter at the bottom thereof substantially equal to the base diameter of the bullet.

* * * * *